US005704711A

United States Patent [19]

Simmons

[11] Patent Number: 5,704,711

[45] Date of Patent: Jan. 6, 1998

[54] PORTABLE MIXING APPARATUS INCLUDING A HAND-HELD TOOL DRIVE ASSEMBLY

[76] Inventor: Michael R. Simmons, 10600 Farley, Overland Park, Kans. 66212

[21] Appl. No.: 690,578

[22] Filed: Jul. 31, 1996

[51] Int. Cl.[6] ..... B01F 9/06

[52] U.S. Cl. ..... 366/199; 366/200; 366/213

[58] Field of Search ..... 366/53–56, 62, 366/63, 197, 199, 200, 201, 209, 213, 214, 217, 219, 220, 221, 225, 230, 231, 605

[56] References Cited

U.S. PATENT DOCUMENTS

| | | | |
|---|---|---|---|
| 1,494,246 | 5/1924 | Jerwan | 366/199 X |
| 2,203,430 | 6/1940 | Goldberg et al. | 366/200 |
| 2,757,911 | 8/1956 | Varady | 366/213 X |
| 2,944,799 | 7/1960 | Larson . | |
| 3,090,604 | 5/1963 | Wheeler | 366/213 |
| 3,430,927 | 3/1969 | Pouzar | 366/213 |
| 3,630,494 | 12/1971 | Patton | 366/201 X |
| 4,403,867 | 9/1983 | Duke | 366/213 X |
| 5,098,193 | 3/1992 | Christensen et al. | 366/213 X |

FOREIGN PATENT DOCUMENTS

| | | | |
|---|---|---|---|
| 180657/34 | 7/1935 | Australia | 366/213 |
| 1008738 | 11/1965 | United Kingdom | 366/213 |
| 1190565 | 5/1970 | United Kingdom | 366/213 |
| 1332457 | 10/1973 | United Kingdom | 366/213 |

*Primary Examiner*—Charles E. Cooley

*Attorney, Agent, or Firm*—Hovey, Williams, Timmons & Collins

[57] ABSTRACT

A portable mixing apparatus (10) for mixing concrete, mortar, roof sealant, paint and other materials that is powered by a hand-held power tool such as an electric drill (22). The mixing apparatus (10) includes a support base (14), a bucket holder (16) carried by the support base (14) for rotational movement on to the support base (14), a drive assembly (18) for rotating the bucket holder (16) on the support base (14), and structure (20) for coupling the drive assembly (18) with the electric drill (22) for powering the drive assembly (18) and therefore rotating the bucket holder (16) for mixing the materials contained in a bucket (12).

6 Claims, 1 Drawing Sheet

PORTABLE MIXING APPARATUS INCLUDING A HAND-HELD TOOL DRIVE ASSEMBLY

BACKGROUND OF THE INVENTION

1. Field of the Invention

The present invention relates to powered mixers for mixing concrete, mortar, roof sealant, paint and other substances. More particularly, the invention relates to a portable mixing apparatus that is powered by a hand-held power tool such as a battery-operated electric drill.

2. Description of the Prior Art

Powered mixers for mixing concrete, mortar, roof sealant, paint and other construction materials are typically large, heavy, difficult to move and expensive. Therefore, they are not suitable for use by "do it yourself" homeowners and small contractors who require a smaller, portable, less expensive mixer for economically mixing smaller quantities of materials.

These large mixers are not ideal for builders and larger contractors either because they must be hauled to a construction site and placed at a fixed location at the construction site due to their size and weight. Workers wishing to use the mixers must therefore walk to the mixers and carry the mixed materials back to their work areas. These large mixers are especially difficult to use in hard to reach areas such as rooftops or the interiors of buildings, or other remote locations.

Another limitation of these large, heavy prior art mixers is that they are powered by dedicated electric or gas motors that are permanently mounted to the mixers. The motors further increase the weight and size of the mixers and therefore decrease their portability. The motors also increase the cost of the mixers.

OBJECTS AND SUMMARY OF THE INVENTION

In view of the foregoing, it is an object of the present invention to provide an improved powered mixing apparatus that is specifically designed for economical use by homeowners, small contractors and the like.

It is a more particular object of the present invention to provide a powered mixing apparatus that is lightweight, portable and less expensive to manufacture.

It is another object of the present invention to provide a powered mixing device that does not require its own dedicated motor.

In view of these objects and other objects that become evident from the following description of the preferred embodiment of the invention, an improved mixing apparatus is provided that is lightweight, portable, and inexpensive to manufacture and that does not require its own dedicated motor.

The mixing apparatus is configured for mixing materials contained in a bucket carried by the apparatus and broadly includes a floor-engaging support base, a bucket holder carried by the support base for rotational movement on the support base, a drive assembly for rotating the bucket holder on the support base, and structure for coupling the drive assembly with a hand-held power tool such as a battery-powered drill. The hand-held power tool powers the drive assembly and therefore rotates the bucket holder for mixing the materials contained in the bucket.

By constructing a mixing apparatus as described herein, numerous advantages are realized. For example, by providing the mixing apparatus with structure for coupling its drive assembly with a hand-held power tool, the mixing apparatus can be powered without requiring its own dedicated motor. Therefore, the mixing apparatus is lighter and more portable than conventional mixers, allowing it to be more easily carried to difficult to reach areas such as rooftops, interiors of buildings, or other remote locations.

Moreover, since the mixing apparatus is powered by a hand-held tool rather than a dedicated motor, it is less expensive to manufacture than conventional mixers. Additionally, since the mixing apparatus does not require a dedicated motor, a plurality of the mixing apparatuses can be positioned at various locations at a construction site and powered by a single hand-held power tool carried to each of the mixing apparatuses.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figures 1, 2, 3:
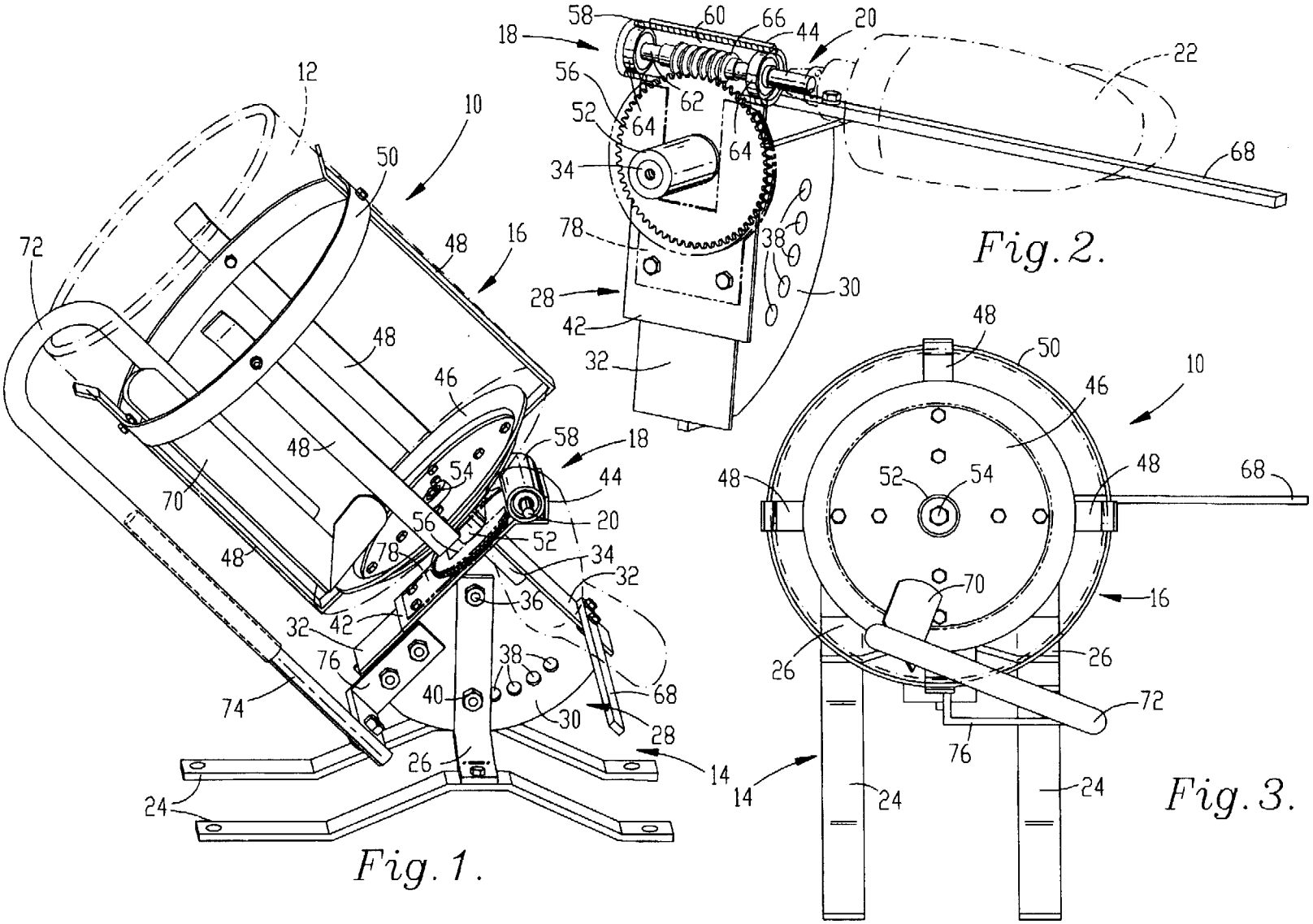
FIG. 1 is a perspective view of a mixing apparatus constructed in accordance with a preferred embodiment of the invention with a bucket and a hand-held battery-operated electric drill shown in phantom lines.
FIG. 2 is a perspective view of the drive assembly of the mixing apparatus with parts broken away and showing the drill in phantom lines.
FIG. 3 is a plan view of the mixing apparatus showing the rim of the bucket in phantom lines.

Turning to the drawing figures, a mixing apparatus 10 constructed in accordance with a preferred embodiment of the invention is illustrated in FIG. 1. The mixing apparatus 10 is configured for mixing concrete, mortar, roof sealant, paint or other materials contained in a container carried by the apparatus 10 such as the bucket 12 and broadly includes a floor-engaging support base 14, a bucket holder 16 carried by the support base 14 for rotational movement on the support base 14, a drive assembly 18 for rotating the bucket holder 16 on the support base 14, and structure 20 for coupling the drive assembly 18 with a hand-held power tool 22. As described below, the hand-held power tool 22 powers the drive assembly 18 and therefore rotates the bucket holder 16 for mixing the materials contained in the bucket 12.

In more detail, the support base 14 includes a pair of spaced-apart, elongated, floor-engaging feet 24, a pair of generally L-shaped legs 26 fixedly attached to and extending upwardly from the feet 24, and a mounting assembly 28 carried by the legs 26. The components of the support base 14 are preferably formed of steel but may also be formed of other suitable materials such as hardened synthetic resin materials.

The mounting assembly 26 includes a wedge-shaped plate 30, an inverted V-shaped bracket 32 welded or otherwise attached to the upper sides of the plate 30, and an elongated shaft 34 fixedly attached to the plate 30 and extending upwardly from one face of the bracket 32. As best illustrated in FIG. 2, the end of the shaft 34 extending from the plate 30 includes a threaded hole.

Advantageously, the mounting assembly 28 can be tilted to a number of different positions relative to the feet 24 and legs 26 to permit the tilt angle of the bucket holder 16 to be adjusted for facilitating mixing of the materials in the bucket 12. To this end, the plate 30 is pivotally mounted between the legs 26 by a bolt 36 that extends through the top of each of the legs 26 and through the apex of the plate 30. Thus, the plate 30 is pivotal relative to the feet 24 and legs 26 about a horizontal pivot axis defined by the bolt 36.

To permit the mounting assembly 28 to be locked in place, the plate 30 includes a plurality of spaced holes 38 adjacent its arcuate edge, and the legs 26 each include a bolt hole positioned to align with the holes 38. When the mounting assembly 28 is positioned so that the holes on the legs 26 align with one of the holes 38, a bolt 40 is inserted through the aligned holes to lock the mounting assembly 28 in place. The holes 38 are preferably positioned to permit the bucket to be tilted from an upright position at 11¼ degree intervals to include 90, 78¾, 67½, 56 ¼, and 45 degrees.

To adjust the tilt angle of the mounting assembly 28, the bolt 40 is removed and the mounting assembly 28 is pivoted so that a different hole 38 aligns with the holes in the legs 26. The bolt 40 is then re-inserted through the aligned holes to lock the mounting assembly 28 in the new position. For example, to position the mounting assembly 28 in its fully tilted position, the holes in the legs 26 are aligned with the leftmost hole of the plate 30, and the bolt 40 is inserted through the aligned holes as illustrated in FIG. 1. To place the mounting assembly 28 in a generally upright position, the holes in the legs 26 are aligned with the rightmost hole of the plate 30 and the bolt 40 is inserted through the aligned holes.

The mounting assembly 28 also includes a generally rectangular shaped plate 42 bolted or otherwise attached to one face of the bracket 32. As best illustrated in FIG. 1, one end of the plate 42 includes a V-shaped channel 44 for supporting a portion of the drive assembly 18 as described below.

The bucket holder 16 includes a plate-shaped base 46 for engaging the bottom of the bucket 12 and four upwardly extending L-shaped arms 48 spaced along the periphery of the base plate 46 and bolted to the underside of the base plate 46. The arms 48 are configured for supporting the sides and engaging the bail of a standard 5-gallon bucket to prevent the bucket 12 from rotating in the bucket holder 16. As best illustrated in FIG. 1, the upper ends of the arms 48 are flared slightly outward to facilitate the placement of the bucket in the bucket holder 16. The bucket holder 16 also includes a ring-shaped collar 50 circumscribing the upper ends of the arms 48 and bolted thereto for adding rigidity to the arms 48.

The bucket holder 16 is carried by the shaft 34 for rotational movement on the support base 14 by a hollow, cylindrical collar 52 that is welded or otherwise attached to the underside of the base plate 46. As best illustrated in FIGS. 2 and 3, the collar 52 slides over the shaft 34 and is held on the shaft 34 by a bolt and washer 54 threaded into the threaded hole of the shaft 34.

As best illustrated in FIG. 2, the drive assembly 18 preferably includes a sprocket wheel 56 and a worm gear assembly 58. The sprocket wheel 56 is conventional and is fixedly attached to the lower end of the collar 52 for rotation with the collar 52.

A washer or bearing assembly (not shown) may be positioned on the shaft 34 between the underside of the sprocket wheel 56 and the plate 42 for spacing the sprocket wheel 56 a short distance from the plate 42 and facilitating rotation of the sprocket wheel 56. The mixer 10 may also include a pinch-guard 78 shown in phantom lines in FIGS. 1 and 2 for covering the sprocket wheel 56 for preventing contact with the wheel 56. The pinch guard 78 preferably attaches over plate 42.

The worm gear assembly 58 is secured in the V-shaped channel 44 of the plate 42 and includes a hollow cylindrical housing 60, an elongated shaft 62 rotatably mounted within the housing 60 by a pair of circular bearings 64, and a worm gear 66 attached to the shaft 62 and intermeshed with the teeth of the sprocket wheel 56. The worm gear 66 utilizes an Acme type threaded rod to greatly reduce the cost of the assembly 58 and to gain the benefit from an included angle of 29 degrees. This makes the worm gear 66 ideal for converting linear loads to rotary motion.

The sprocket gear 56 and the worm gear assembly 58 cooperate to permit the mixer 10 to be powered by a relatively low torque hand held power tool. Specifically, there are a greater number of teeth on the sprocket gear 56 than flightings or turns on the worm gear 66. This gives the worm gear a mechanical advantage and permits it to be rotated with little torque.

As best illustrated in FIG. 2, the shaft 62 extends a short distance from one end of the housing 60 to serve as the structure 20 for coupling the drive assembly 18 with a hand-held power tool such as the battery-operated drill 22. The portion of the shaft 62 that extends from the housing is preferably approximately 1' in length and ⅜" in diameter. This size permits the jaws of the drill 22 to be quickly and easily placed over the end of the shaft 62. Then, when the drill 22 is operated, it rotates the shaft 62, worm gear 60, sprocket wheel 58, and collar 52 and therefore rotates the bucket holder 16 and the bucket 12 supported thereon for mixing the materials contained in the bucket 12.

To prevent rotation of the drill 22 when the drill 22 coupled with the shaft 62, the mixing apparatus 10 preferably includes an elongated rod 68 bolted or otherwise attached to one face of the bracket 32 for supporting the base of the drill 22. The mixing apparatus 10 may also be provided with a mixing paddle 70 that scrapes the sides of the bucket 12 during rotation of the bucket holder 16 to facilitate mixing of materials such as concrete. The paddle 70 is supported on a U-shaped, hollow tube 72 that straddles the bucket 12. The pipe 72 is in turn supported on an elongated bar 74 attached to the mounting assembly 28 by an L-shaped bracket 76 bolted to the plate 30.

Although the invention has been described with reference to the preferred embodiment illustrated in the attached drawing figures, it is noted that equivalents may be employed and substitutions made herein without departing from the scope of the invention as recited in the claims. For example, although the mixer of the present invention is preferably powered by a hand held power tool such as a drill, it can be powered by any portable motor that can be easily carried to the mixer. Additionally, although the mixer is preferably configured for supporting and rotating a bucket, it can also be configured for rotating other containers or may be equipped with a tub that is fixedly attached to the mounting assembly.

Having thus described the preferred embodiment of the invention, what is claimed as new and desired to be protected by Letters Patent includes the following:

1. A portable mixing apparatus for mixing materials contained in a bucket, said apparatus comprising:

a floor-engaging support base;

a bucket holder for holding the bucket, said bucket holder being carried by said support base for rotational movement on said support base;

a drive assembly for rotating said bucket holder, said drive assembly including a sprocket gear attached to said bucket holder and a worm gear attached to said support base and intermeshed with said sprocket gear; and a shaft attached to said worm gear and configured for coupling with a rotatable jaw of a handheld power tool for rotating said worm gear when the handheld power tool is operated.

2. The mixing apparatus as set forth in claim 1, further including structure for selectively adjusting the tilt angle of said bucket holder relative to said support base.

3. The mixing apparatus as set forth in claim 1, further including a mixing paddle for mixing the materials in the bucket while the bucket is being rotated by the bucket holder and a support bar fixed to said support base for supporting said mixing paddle in the bucket.

4. A portable mixing apparatus for mixing materials contained in a bucket, said apparatus comprising:

a floor-engaging support base including a fixed shaft;

a bucket holder for holding the bucket, said bucket holder being mounted on said shaft for rotational movement on said support base;

a drive assembly for rotating said bucket holder on said shaft, said drive assembly including a sprocket gear fixedly attached to said bucket holder and a worm gear intermeshed with said sprocket gear and fixedly attached to said support base; and a shaft coupled with said worm gear for rotating said worm gear, said shaft including an end extending outwardly from said support base and configured for coupling with the jaw of a drill for rotating said worm gear when the drill is operated.

5. The mixing apparatus as set forth in claim 4 further including structure for selectively adjusting the angle of said bucket holder relative to said support base.

6. The mixing apparatus as set forth in claim 4, further including a mixing paddle for mixing the materials in the bucket while the bucket is being rotated by the bucket holder and a support bar fixed to said support base for supporting said mixing paddle in the bucket.

* * * * *